US007829773B2

(12) United States Patent
Shamblin

(10) Patent No.: US 7,829,773 B2
(45) Date of Patent: Nov. 9, 2010

(54) TREMOLO MECHANISM HAVING BRIDGE SEGMENTS ADJUSTABLE IN THREE DIMENSIONS

(76) Inventor: Ellis Neal Shamblin, 11513 Bingham St., Cerritos, CA (US) 90703

( * ) Notice: Subject to any disclaimer, the term of this patent is extended or adjusted under 35 U.S.C. 154(b) by 0 days.

(21) Appl. No.: 12/214,778

(22) Filed: Jun. 23, 2008

(65) Prior Publication Data

US 2009/0314152 A1 Dec. 24, 2009

(51) Int. Cl.
*G10D 3/00* (2006.01)

(52) U.S. Cl. ..... 84/313; 84/267; 84/297 R

(58) Field of Classification Search ..... 84/313
See application file for complete search history.

(56) References Cited

U.S. PATENT DOCUMENTS 4,457,201 A * 7/1984 Storey ..... 84/313
4,475,432 A * 10/1984 Stroh ..... 84/314 N
4,512,232 A * 4/1985 Schaller ..... 84/313
4,611,523 A * 9/1986 McFarland ..... 84/313
4,632,005 A * 12/1986 Steinberger ..... 84/313
4,796,505 A * 1/1989 Takeuchi ..... 84/313
5,196,641 A * 3/1993 Schaller ..... 84/740
5,311,804 A * 5/1994 Wilkinson ..... 84/313
5,359,144 A * 10/1994 Benson ..... 84/313

* cited by examiner

*Primary Examiner*—Jeffrey Donels
*Assistant Examiner*—Christopher Uhlir
(74) *Attorney, Agent, or Firm*—William L. Chapin

(57) ABSTRACT

A tremolo mechanism for varying the pitch of the strings of a musical instrument to create a vibrato effect includes a plurality of separately adjustable bridge segments, one for each string, which are mounted onto a pivotable plate and adjustable longitudinally to vary tension and hence frequency of a string, vertically to adjust the height of a string above the instrument, and laterally to align the strings horizontally with the instrument body.

20 Claims, 6 Drawing Sheets

44
47

28
50
72R
52

28
72L
9
36
74
71
50
8B
64
44
72R
70
46
56
54

9
48
54
8B
10

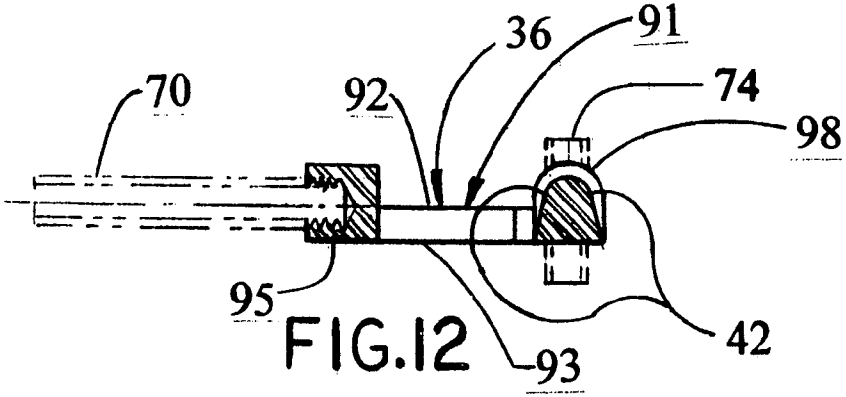
FIG.12
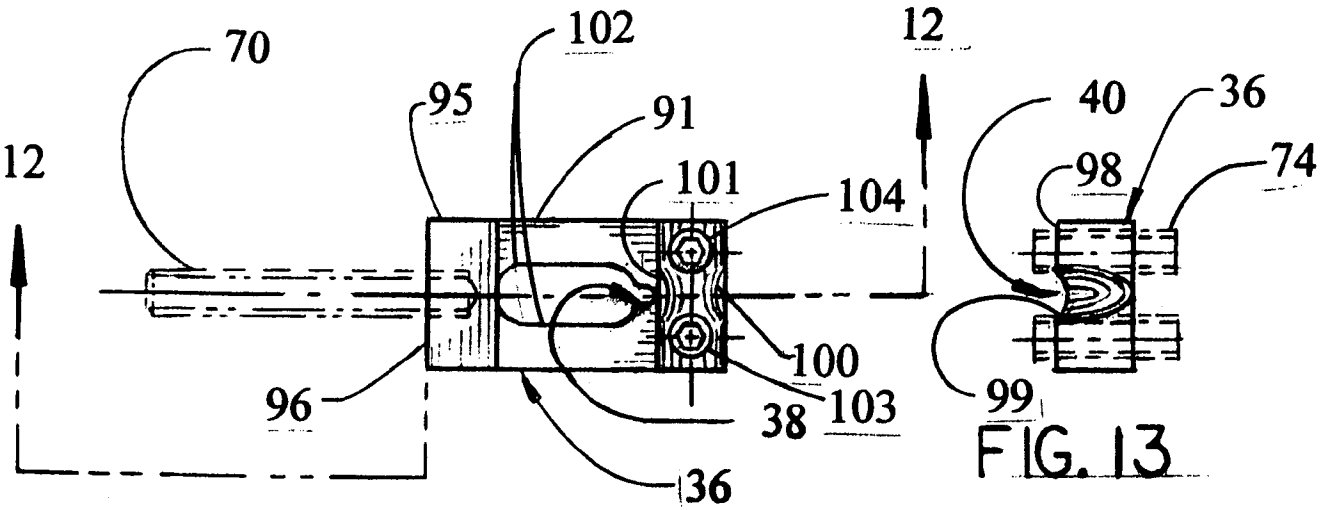
FIG.13
FIG.11

TREMOLO MECHANISM HAVING BRIDGE SEGMENTS ADJUSTABLE IN THREE DIMENSIONS

BACKGROUND OF THE INVENTION

The following invention is a tremolo mechanism to be used on stringed musical instruments. It is shown mounted on a electric guitar, but the same principles can be used on other stringed instruments, and must not be limited to the guitar only. It is used to create a vibrato sound at the discretion of the musician as it fits into the musical scheme of the song.

This tremolo mechanism is actuated by the hand, which does the picking (usually the right hand), but can be mounted for left handed musicians using the left-handed tremolo mechanism. This is done by depressing the tremolo arm, which releases the tension on the strings to lower the pitch, and moving it back into its original position raises the pitch to its original setting. Moving the tremolo arm back and forth creates the vibrato sound, and after it is used the guitar returns to perfect tune when the hand lever is released. This has been a major problem on existing tremolo mechanisms. The problem of the musical instrument going out of tune is so bad that a lot of musicians do not use their tremolos. This tremolo mechanism rotates about a high tolerance shaft, with means to make sure that when it is used it will return in perfect tune.

There is a need to have a tremolo mechanism that when a string breaks it doesn't knock the rest of the strings out of tune, and replacing a string is fast and easy. This tremolo mechanism has this feature as a priority. When installing strings, instead of pushing the strings up through small holes in the back portion of the guitar, the anchor on the string is pushed down through the top portion, through a bridge segment into the anchor block, and then when pulled up it locks into place.

There is a need also to have an easy way to adjust the intonation without using wrenches and screwdrivers. This is done with six knurled knobs, one for each string, that can be adjusted by fingers only, and are locked into place by locking tangs.

There is a need to be able to make fine adjustments to the strings after the tremolo mechanism has been hard mounted on the instrument. This tremolo mechanism allows for adjustments in all three degrees of freedom: 1. string height, 2. adjustment of the bridge for intonation, and 3. adjustment of all strings latterly for equal spacing at the edges of the neck of the instrument fret board.

There is a need to have the tremolo arm stay in the position that the performer wants, instead of flopping all around, and can be reached easily while playing. This tremolo mechanism has this feature built in.

PRIOR ART

Tremolo mechanisms are used to alter the pitch on electric guitars and other stringed musical instruments. They are usually mounted on solid body electric guitars. The strings are mounted by anchoring them in the tremolo mechanism, in their respective places, and then threading them down over the fret board across the nut, and then connected to the tuners. Each string is then individually tuned to the correct pitch.

The musician varies the pitch by depressing the tremolo arm, which lowers the pitch, and by letting the arm return to its original position, raises the pitch to its original setting. Oscillating the tremolo arm back and forth creates the vibrato effect. Many musicians do not use their tremolo mechanisms, on prior art, because it causes the instrument to go out of tune.

There are several tremolos that have tried to keep this from happening, and it's been a big problem. Floyd Rose, U.S. Pat. No. 4,171,661, has a tremolo that requires the instrument to be specially machined, with the pivot plate recessed into the face of the instrument about one quarter inch. To have one mounted, requires taking it to a special shop, and the price to have it mounted will cost more than the tremolo itself.

The Rose Tremolo pivots about two stakes, and is what is called a free floating tremolo, which means that the equilibrium point where it stops, after use, is somewhere between where the tension load of the strings, and the tension load in the springs are equalized. When a string is broken, the combined load of the strings is less than the combined load in the springs, therefore, the return springs over compensate and pull the tremolo back past the equilibrium point, causing an strings to go out of tune. When this happens it is impossible to continue playing until the song is over. To continue playing, the broken string needs to be replaced. This requires retuning all of the strings. It takes a screwdriver, or Allen wrench, to release the clamp on the nut on some instruments, before the tuners can be turned to tighten or release the tension in the strings.

Another problem with the Rose Tremolo is setting the intonation. This is done by varying the distance between the bridge segments on the tremolo and the nut on the neck of the instrument. This is where the strings make contact on the instrument without being depressed. The longer the span between these points the lower the pitch, and the shorter the distance between these points the higher the pitch. The instrument can be in perfect tune when the strings are picked open, for example the little E string, but when moving up to the twelfth fret and picking the little E string it may or may not be in tune, depending on where the bridge segments have been set. Setting these bridge segments is called setting the intonation of the instrument. So when the little E string is picked it will be in perfect tune at open E and also at E on the twelfth fret of the instrument. This is also true for all of the other strings in their own respective keys.

Rose has provided for adjusting the intonation, but it is a long time consuming job. This requires the use of an Allen wrench or screwdriver, and the loosening up of the string, setting the bridge segments, retuning, and checking with an electronic tuner to see if the first guess was okay. This can go on four or five times with each string. The complications mentioned are even compounded more when a new set of strings are installed. If a string breaks while playing in a concert on fixed bridge tremolos, good players can just brush it out of the way, and improvise using the appropriate other strings until the song is over. On the Rose and other screw and stake mounted tremolos, breaking a string causes all the other strings to go out of tune, and improvising using the other appropriate strings until the song is over is next to impossible. It then becomes a major job to replace the string and retune the instrument.

OBJECT OF THE INVENTION

The object of this invention is as follows:

1. To make a tremolo mechanism that, after it is used, the instrument will still be in tune.
2. To make a tremolo mechanism that is easy to install.
3. To make a tremolo mechanism that can be re-adjusted, even after it is hard mounted.
4. To provide easy string height adjustments above the fret board of the instrument.

5. To provide an easy way to adjust the intonation, and a system to lock it in place after the adjustment.
6. To provide a way to move all strings laterally, at the bridge, after the tremolo mechanism has been hard mounted. This will eliminate the problem of having the strings closer to the edge of the fret board on one side of the neck than the other.
7. To make a tremolo mechanism that is easy and fast to install a new string, by pushing the string anchor down through the top of the tremolo until it locks in place, instead of pushing it up through the back side of the instrument.
8. To provide a tremolo arm that doesn't flop all over when playing, and has means for adjustment to provide rotational resistance to stay in place for easy access.
9. To make a tremolo mechanism that after it is used, the strings will automatically center themselves using the string centering guides on the bridge segments.
10. To make a tremolo mechanism that minimizes string fatigue, that causes the strings to break, where they make contact on the bridge segments.
11. To make a nice looking piece of hardware that is not cumbersome and enhances 116. the instrument both functionally and in appearance.

BRIEF DESCRIPTION OF THE DRAWINGS

FIG. 11 shows a single bridge segment 36 with a string centering guide portion 38, a saddle portion 40, and a waist reduction portion 42.

FIG. 12 is a section view through the center of the bridge segment portion of FIG. 11, showing the installation of the intonation adjusting screws 70.

FIG. 13 is a front elevation view of the bridge segment shown in FIG. 11.

DETAILED DESCRIPTION OF THE PREFERRED EMBODIMENTS

Figure 1:
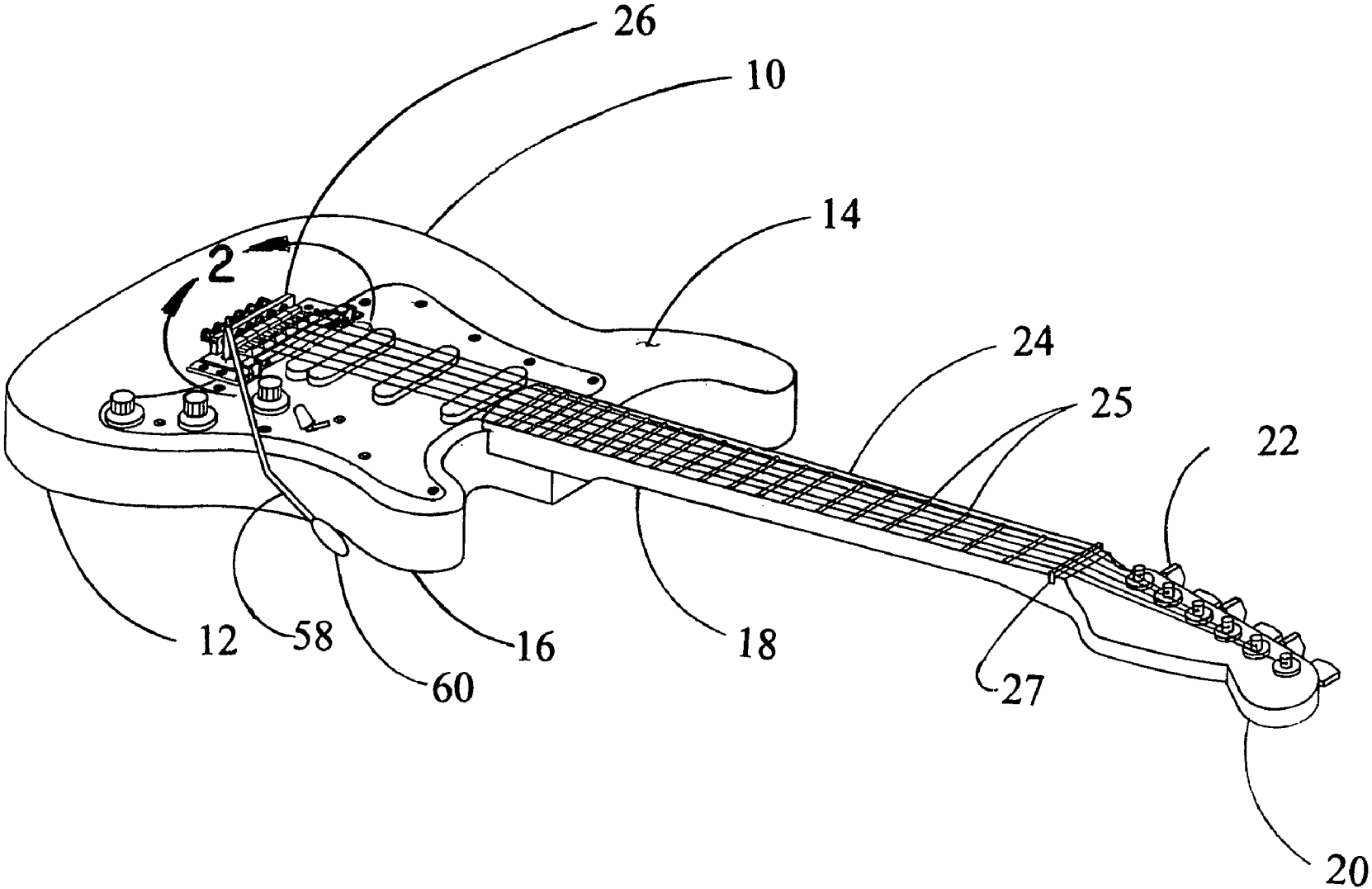
FIG. 1 is a perspective view of the tremolo mechanism mounted on a solid body guitar. It also shows where it is mounted with respect to the other embodiments usually found on solid body guitars.

Referring now to the drawings, FIG. 1 shows a standard solid body electric guitar (10) with a tremolo mechanism (26) of the present invention mounted on the front surface (14) of the guitar. Guitar (10) includes a body (12) having a front surface (14), a back surface (16), a neck (18) which extends upwardly from the body, a tuning head (20) which extends upwardly from the upper end of the neck (18), a plurality of mechanisms (22) which protrude from the tuning head, and a plurality of strings (24) which are anchored at one end thereof to the tremolo mechanism (26) and the other end thereof to the tuning mechanisms (22).

The strings (24) are anchored at a first, lower end thereof to a bridge or in the present case to tremolo mechanism (26). The upper ends of the strings (24) are tensioned to contact the upper edge of a transversely disposed rib located at the junction between the neck (18) and tuning head (20) and referred to as a nut (27). The strings (24) are spaced above the upper surfaces of a plurality of laterally disposed, longitudinally spaced apart playing frets (25), and are thus enabled to vibrate freely at a length between an upper node located at the nut, and a lower node located at the bridge or near a fret (25) when pressed there by finger pressure.

The tremolo mechanism (26) is located at a lower part of the body (12) where the strings are anchored and comprises the bridge portion to which the plurality of strings (24) are attached and extended upwards to their respective tuning pegs (22). The tuning mechanisms (22) enable each string (24) to be tuned to a pre-selected pitch in order to tune the guitar to pre-selected musical keys. The tremolo mechanism (26) enables the performer to change the pitches of the strings (24) in unison by depressing the tremolo arm (58) (FIG. 2) back and forth to create a vibrato or tremolo effect as desired.

Referring to FIGS. 2, 3, 6 and 8, it may be seen that tremolo mechanism (26) according to the present invention includes a laterally elongated, rectangularly-shaped pivot plate (28). Pivot plate (28) has protruding upwardly from the upper surface thereof a laterally elongated, square cross-section, rectangularly-shaped pivot shaft support bar (29) located at the front laterally disposed edge of the pivot plate. The pivot plate (28) has protruding downwardly from the lower surface thereof a laterally centrally located pivot block (30) which has in front elevation view a laterally elongated rectangular shape, and a width slightly less than that of the pivot plate.

Pivot shaft support bar (29) has protruding from the left transverse vertical end face thereof a circular cross-section left pivot shaft (31L), and from the right transverse face of the pivot shaft support bar a right pivot shaft (31R) which is axially aligned with the left pivot shaft. Left and right pivot shafts (31L), (31R) are rotatably received in a pair of laterally spaced apart bearing journal bushings (82L), (82R) inset into laterally inwardly facing transverse faces of a pair of laterally opposed left and right pivot shaft bearing support blocks (32), (34), respectively. Bushings (82) are high tolerance, i.e., precision. type.

Tremolo mechanism (26) also includes a plurality of adjustable bridge segments (36), a transverse rail (44) for adjusting laterally all strings in unison on the neck of the instrument, intonation adjustment knobs (54) for individually adjusting the tuning or intonation of each string (24), a tremolo arm (58) for creating the vibrato effect, a tremolo arm knob (60), a return spring attachment bracket (62), adjustable bridge segment springs (64), tremolo return springs (66) and a tremolo arm torsional resistance spring (68).

Items (28) through (36) and (44), (54), (58), (62 of the present invention may be made of any suitably durable material (for example steel, aluminum), or any metal that is strong enough and can be plated. Items (64), (66) and (68) are springs and are made from stainless or spring steel. Items (70) through (80) are standard hardware screws made out of steel or stainless steel. Item (60) knob may be made out of rubber, plastic or metal.

The following hardware is used for assembly:

As shown in FIGS. 2, 3, 6, 8 and 9, 11, 12 and 13, tremolo mechanism (26) includes an individual threaded stud (70) which protrudes rearward from each adjustable bridge segment (36) for adjusting the intonation of each individual string (24) by turning an individual adjustment knob (54), which is screwed onto the rearwardly protruding end of the stud. Socket head set screws (74) are provided for individually adjusting the height of each bridge segment, socket head set screws (72) at each end of the transverse rail (44) which is laterally slidably mounted in an extended lip portion of the pivot plate (28), flathead screws (76) which mount pivot plate (28) to pivot block (30), oval head screws (78) for mounting the tremolo mechanism (26) to a musical instrument, and round head screws (80) for mounting attachment bracket (62) for tremolo return spring (66).

As shown in FIGS. 2, 3, 6, 8, 9, and 11-13, pivot plate (28) has protruding upwardly from a rear laterally disposed edge thereof a laterally elongated vertically oriented plate which comprises an extended lip portion (71). Lip portion (71) has formed in a rear vertical surface thereof a forward extending, laterally elongated rectangular groove (50). Groove (50) slidably holds therein a rectangular bar-shaped transverse rail (44). Rail (44) is adjustable in lateral position within groove (50) by means of left and right socket head screws (72L), (72R) which are screwed into threaded holes that extend into opposed left and right vertical transverse faces of extended lip portion (71) and bear against left and right vertical faces, respectively, of the transverse rail.

Figures 8A, 8B, 9, 10:
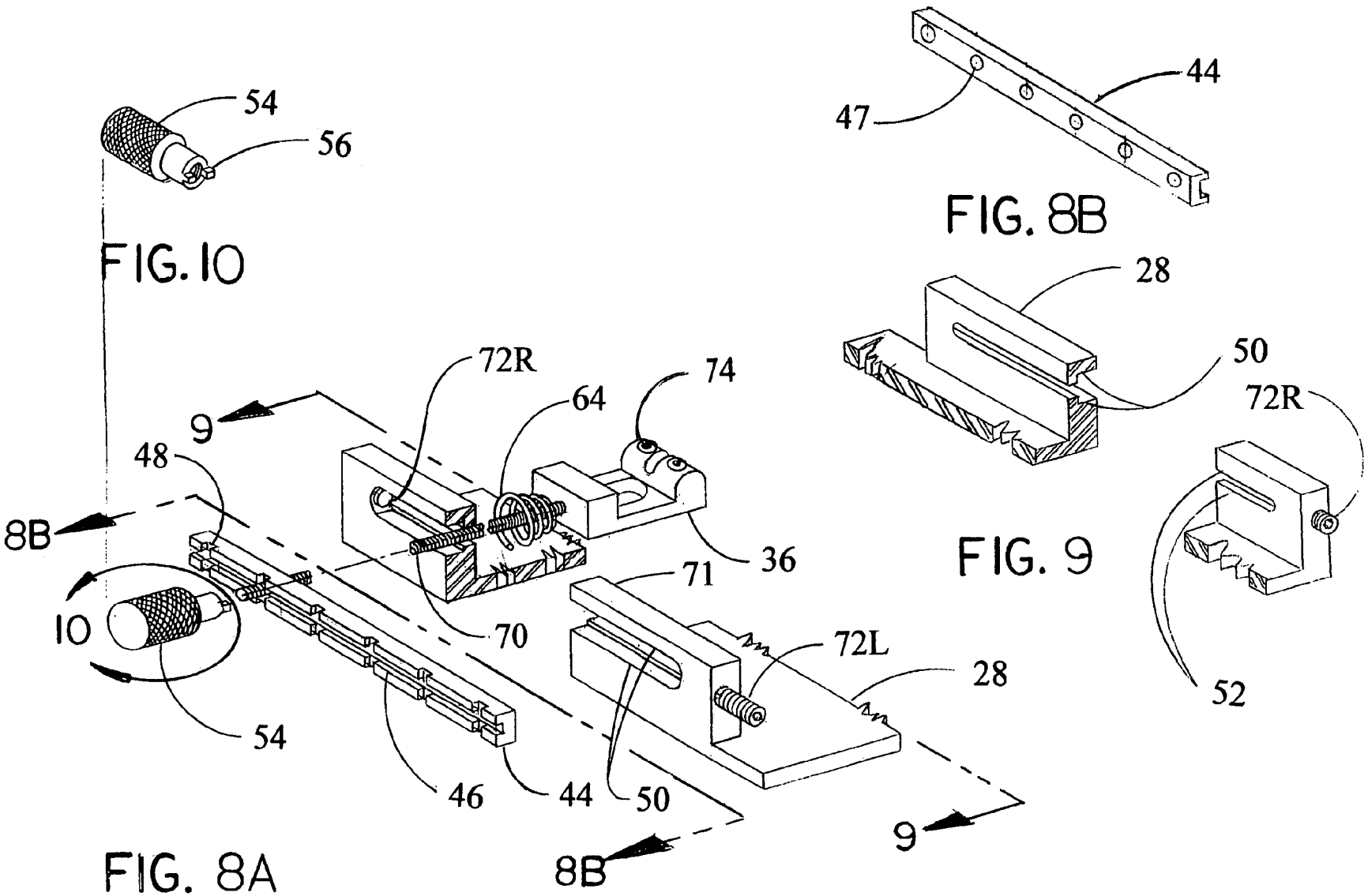
FIG. 8A is an exploded view showing how the transverse rail is assembled in the pivot plate embodiment, the groove 50, that it sets in, and the way it can be adjusted from end to end with set screws. It also shows the horizontal and vertical grooves 46 and 48 in the transverse rail embodiment, that the locking tang portions of the intonation adjusting knobs set in, with means for 90 degree increments of adjustment for all intonation adjustment knobs.
FIG. 8B is a fragmentary view showing a transverse rail of FIG. 8A.
FIG. 9 shows the full length slot portion 52 that allows the socket head set screws of each bridge segment portion to be moved from side to side, in order to properly align. the bridge segments on the instrument.
FIG. 10 shows a typical intonation adjustment knob with means to make sure that the knobs stay locked via the locking tangs 56 and the grooves in the transverse rail.

As may be seen best by referring to FIG. 8A, transverse rail (44) has extending forward into the rear vertical face thereof a horizontally disposed rectangular cross section channel groove (46) which extends the full length of the rail. As shown in FIG. 8B, channel groove (46) has through an inner, front vertical wall thereof a plurality of through-bores (47) which are laterally spaced apart. The number and spacing of the bores (47) corresponds to the number of strings and spacing therebetween of a guitar which tremolo mechanism (28) is intended to be used with, e.g., 6 strings in the example shown in FIGS. 1 and 2.

As shown in FIG. 8A, the rear vertical face of transverse rail (44) also has extending perpendicularly forwards there-into a plurality of vertically disposed rectangular cross section cross grooves (48). Each cross-groove (48) has the same cross-sectional shape and depth as channel groove (46), and is centered on a separate through-hole (47).

As may be understood by referring to FIGS. 8 and 9 in conjunction with the description below, each horizontally disposed channel groove (46) is adapted to receive and retain the forward protruding tangs (56) of an intonation adjustment knobs (54) when the tangs are horizontally oriented, while vertically disposed cross grooves (48) are adapted to receive the tangs when the knob is rotated 90 degrees to thus vertically align its tangs.

As shown in FIGS. 8 and 9, the front vertical wall of extended lip portion (71) is penetrated by a rearwardly protruding, laterally elongated slot (52). Slot (52) penetrates rear groove (50) at the horizontal mid-plane of the rear groove, which is vertically centered on through-holes (47), and has a height slightly larger than the diameter of the through-holes and slightly smaller than that of rear groove (50).

Figure 3:
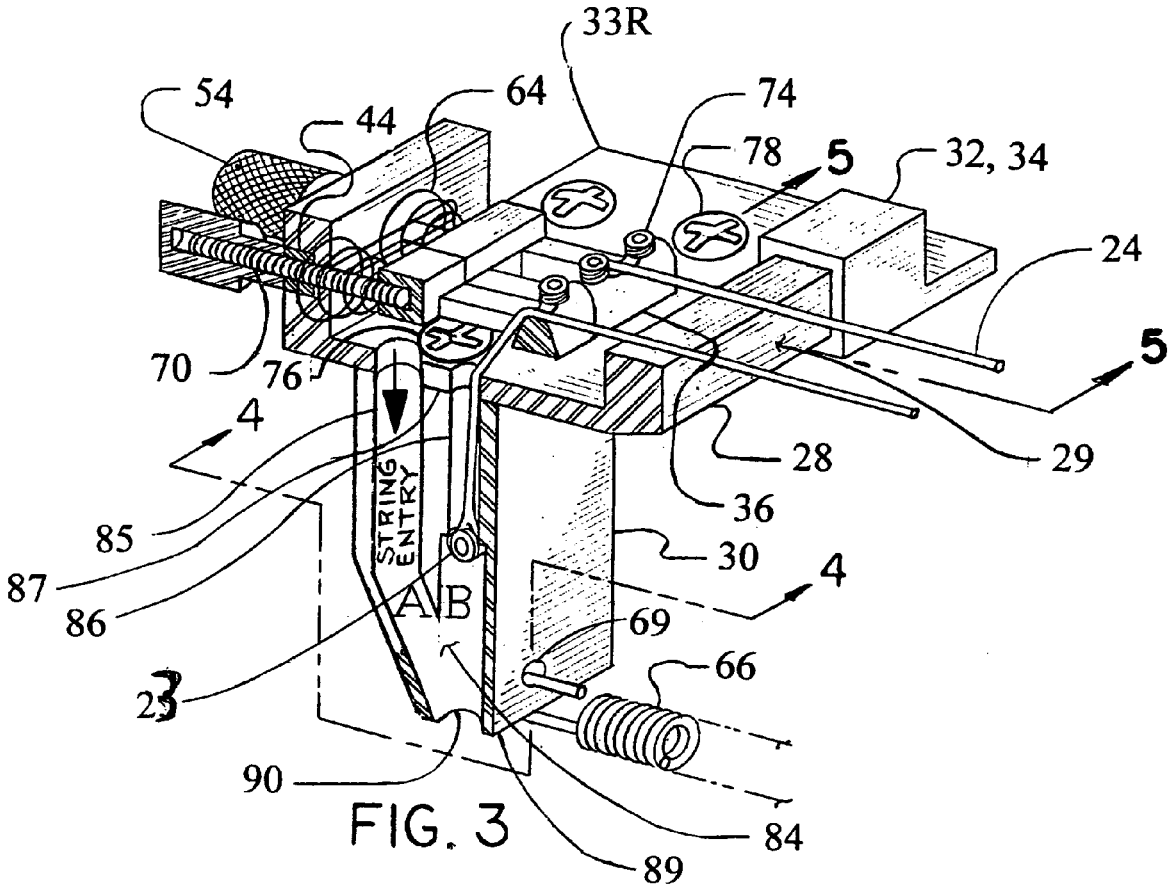
FIG. 3 is a perspective view from FIG. 2, showing how the strings are installed. They are installed by pushing them down through entry hole A to where they pass over to hole B through the center portion that is cut out between hole A and hole B. As soon as the string passes over to hole B, it is then pulled up, which causes it to catch at the necked down portion of hole B. The strings are then threaded down the fret board portion, over the nut, attached to the tuning keys, as shown in FIG. 1, and tuned to their respective pitches. This is typical for all strings.
Figure 4:
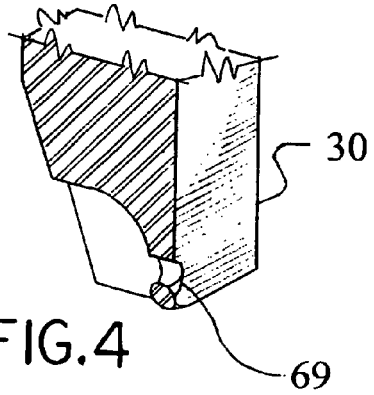
FIG. 4 is a perspective section view from FIG. 3 showing the bearing journals that the return springs are attached to, of which there are a plurality of them available to be used according to how stiff the guitarist wants the action to be.
Figure 5:
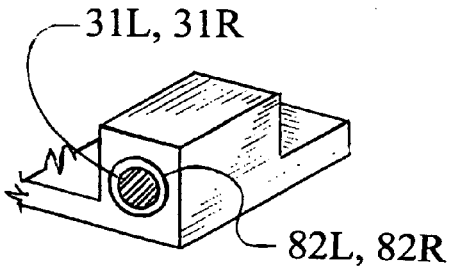
FIG. 5 is a perspective view taken from FIG. 3 showing the bushings that are used in the shaft pivot mounts.
Figure 6:
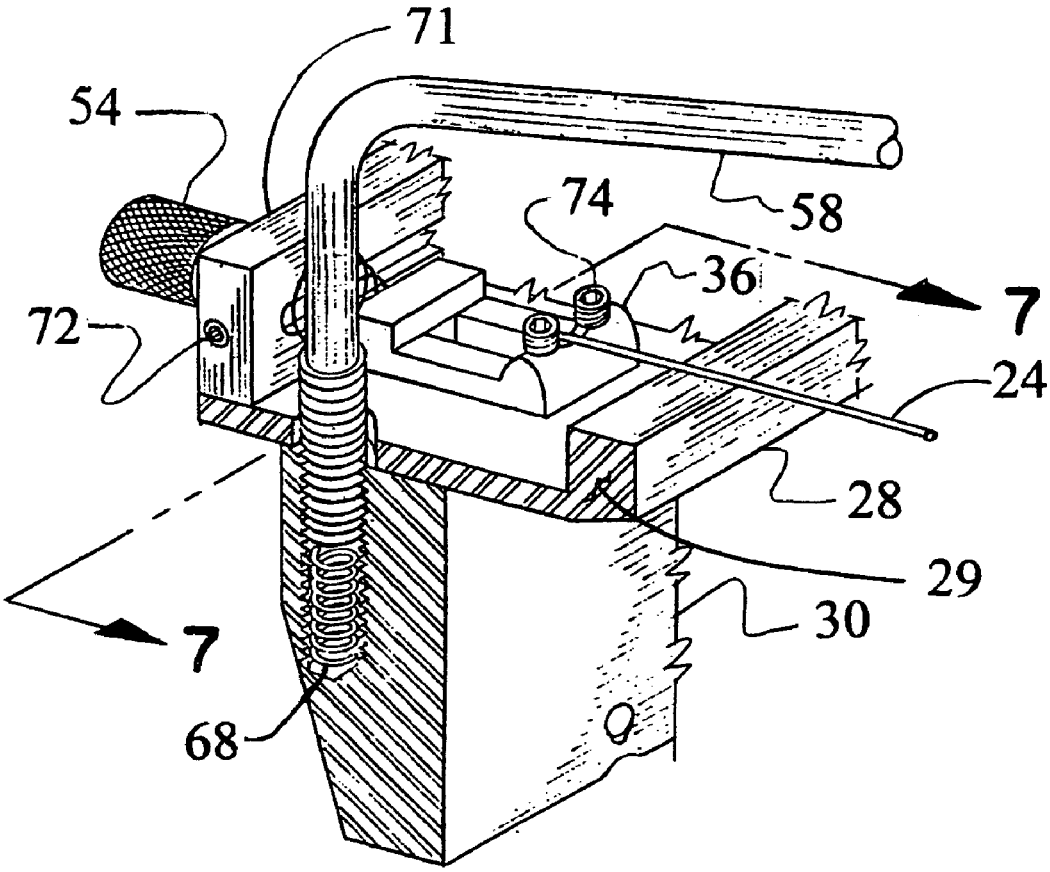
FIG. 6 is a perspective view taken from FIG. 2, showing the tremolo arm installation and the torsional resistance spring. This makes it possible for the artist to adjust the tremolo arm, by screwing it in or out to the torsional stiffness desired.
Figure 7:
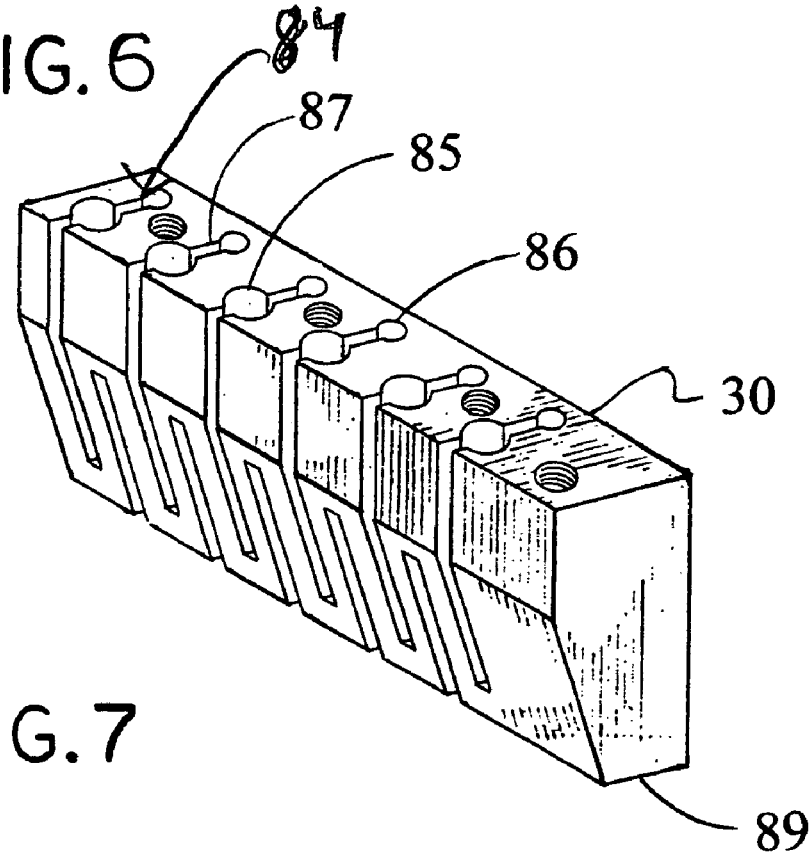
FIG. 7 is a perspective view of the back side portion of the pivot block, showing the cutouts between holes A and B as shown in FIG. 3, and the cutouts for the spring return journals as shown in FIG. 4.

As shown in FIGS. 3 and 7, pivot block (30) is provided with a plurality of laterally spaced apart string-holder bores (84), which extend perpendicularly downwards into the pivot block from its horizontal upper surface. There is a separate string holder bore (84) for each of the strings of the guitar, such as the 6 shown in FIG. Each string-holder bore (84) has in upper plan view a key-hole like shape, including a relatively larger diameter, generally circular cross-section rear entry channel (85), a smaller diameter front anchor channel (86), and an elongated transitional channel slot (87) of still smaller width which extends forward from the rear channel to the front channel.

As shown in FIG. 3, string-holder bores (84) preferably penetrate the lower surface (89) of pivot block (30) to thus form lower access openings (90) to the string anchor bores. This construction enables a broken string to be pushed downwards through an access opening (90) for easy removal.

As may be understood by referring to FIG. 3, the foregoing construction enables a guitar string (24) having fixed to one end thereof a disk-shaped button or anchor (23) of smaller diameter than rear entry channel (85) of string holder bore (83), but of larger diameter than front anchor channel (86), inserted downwards into the rear entry channel. The vertically disposed string (24) is then slid forward through transition channel (87), and pulled upwards until the anchor button (25) of the string lodges against the lower surface of the pivot plate (28), which forms with the anchor bore an anchor "pocket."

The bridge segments (36) as shown in FIGS. 2, 3, 6, 8 and 11, are assembled before mounting to the tremolo mechanism by bonding a separate rearwardly protruding threaded stud (70) to the front body portion of each bridge segment (36). This construction makes a permanent assembly so when the intonation adjusting knobs (54) are turned, the threaded studs (70) will not come out of bridge segments (36). A pair of laterally spaced apart, vertically disposed string height adjustment set screws (74) are installed in each bridge segment (36). These are used to adjust the height of the strings (24) so they will not buzz or rattle by contacting the frets. There are six of these bridge segments (36) shown but, the same principle can be used on any instrument with multiple string combinations.

As may be understood by referring to FIGS. 8A 9, the bridge segments (36) are assembled to the pivot plate (28), by pushing each threaded stud (70) through a separate spring (64), through front slot (52) and rear groove (50) of extended lip portion (71) of pivot plate (28), and through a separate bore or through-hole (47) through the transverse rail (44) until a sufficient length of the stud (70) protrudes rearward through the bore (47) of the transverse rail to enable an intonation adjusting knob (54) to be threaded onto the stud. As may be seen best by referring to FIGS. 3 and 8, springs (64) have a helical construction and a frusto-conical shape, the smaller diameter front end of which bears against the rear transverse vertical surface of a bridge segment (36).

Figure 2:
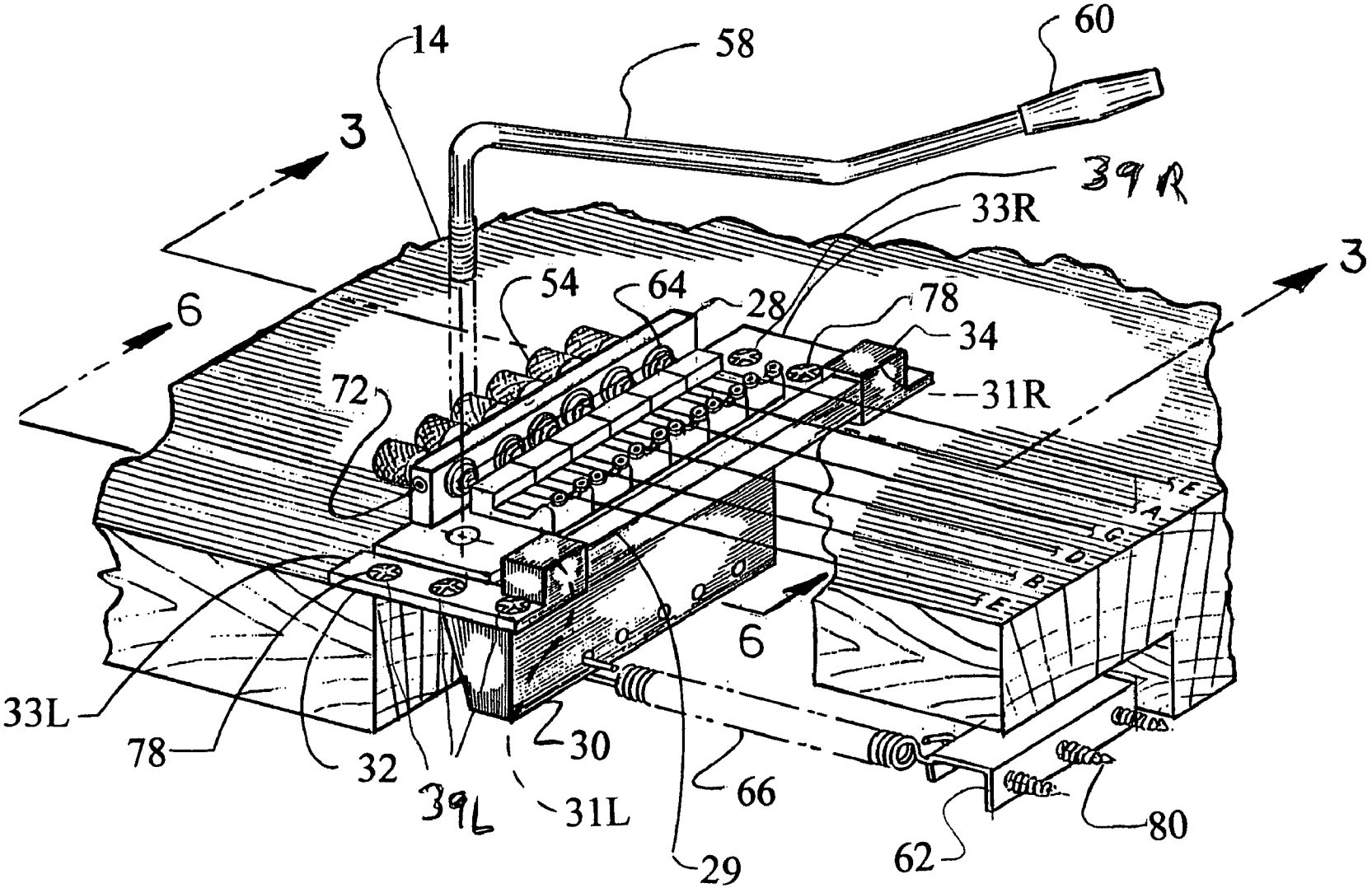
FIG. 2 is a magnified perspective view taken from FIG. 1, showing how the tremolo mechanism and all its preferred embodiments are mounted. For clarity only, one tremolo return spring is shown, but a plurality of springs may be used.

The precision bearing journal bushings (82L), (82R) have previously been installed into the pivot shaft mounts (32) and (34) respectively, and then attached to the pivot plate (28). As shown in FIG. 2, the pivot shaft bearing support blocks (32) and (34) have protruding rearwards therefrom flat mounting flanges (33L), (33R), respectively, which are attached with three oval head screws (78) each, which are inserted into holes (39L), (39R) through the mounting flanges and screwed into body (14) of guitar (10).

The tremolo return spring attachment bracket (62) (FIG. 2) is mounted with three round head wood screws (80) to an inner rear part of body (14). The tremolo return spring(s) (66) are hooked into return spring attachment structure consisting of holes (69) in the pivot block (30) on one end, and the other ends are attached to the tremolo return spring attachment bracket (62). There can be one to five or more of these springs (66) installed depending on how stiff the musician wants the tremolo action to be.

The tremolo arm resistance spring (68) is mounted into the pivot block (30), and then the tremolo arm (58) with the end knob (60) is screwed into the pivot block (30) through the pivot plate (28) on top of the tremolo arm resistance spring (68), compressing the spring to create the desired torsional resistance required by the artist.

FIGS. 11-13 illustrate the construction of adjustable bridge segments (36). As shown in those figures, each bridge segment (36) includes a longitudinally elongated, rectangular block-shaped body (91). Body (91) includes a base section (92) which has a flat lower surface (93), a flat upper surface (94) parallel to the lower surface, and a laterally disposed, rectangular block-shaped rear transverse flange (95) which protrudes upwardly from the upper surface of the body. Rear transverse flange (95) has a rear vertical face (96). A threaded stud (70) protrudes perpendicularly rearwards from vertical face (96) of the bridge segment (36).

Each bridge segment (36) also has a front transversely disposed string guide flange (38) which protrudes upwardly from base section (92). As shown in FIG. 11, string guide flange (38) has in upper plan view a laterally elongated, rectangular block-shape. As shown in FIG. 12, the upper surface (98) of string guide flange (38) has in side elevation view an arcuately curved, convex, semi-cylindrical shape.

As may be seen best by referring to FIGS. 12 and 13, string guide flange (38) has formed in the upper surface (98) thereof a saddle (40). Saddle (40) has therein a laterally centrally located waist reduction groove (42). As shown in the figures, waist reduction groove (42) has in front and rear elevation views an arcuately curved, concave contour (99) which is symmetrical about a vertical mid-plane of string guide (38). As is also shown in the figures, saddle (40) has in front and rear surfaces thereof front and rear arcuately curved concave grooves (100), (101), which are shaped similarly to groove (99), and combine therewith to form a saddle shaped waist reduction region (42). This construction ensures that a string (24) is properly centered within the grooved saddle (40) of a bridge support (36), even after tension in the string has been cyclically varied by operation of tremolo mechanism (26).

As shown in FIG. 11, base section (92) of adjustable bridge segment (36) has through its thickness dimension a longitudinally elongated slot (102) for receiving the anchored end of a string (24). Also, as may be seen best by referring to FIGS. 12 and 13, a pair of string height adjustment socket head set screws (74) are received in a pair of threaded bores (103), (104) disposed vertically through bridge segment string guide (38), on opposite sides of centrally located saddle (40). As may be understood by referring to FIGS. 2, 3 and 6, when strings (24) are installed on guitar (10) and anchored in place by tremolo mechanism (26), tension in the strings exerts a downward force on saddles (40) of adjustable bridge segments (36). The downward force causes lower ends of height adjustable screws (74) (see FIGS. 12 and 13) to bear against the upper surface of pivot plate (28). This construction enables the height of saddles (40) and hence of strings (24) to be adjusted by turning height adjustment screws (74).

I claim

1. A tremolo mechanism for varying tension and hence vibration frequencies of a plurality of strings of a stringed musical instrument having a body, a neck protruding from said body, a tuning head terminating said neck, a bridge attached to said body for securing first ends of a plurality of strings, a plurality of longitudinally disposed strings extending from said bridge above an upper surface of said neck and across and in contact with a nut comprising a laterally disposed rib which protrudes upwardly from said neck near an upper end thereof, said strings being secured at second ends thereof to individual tuning mechanisms located between said nut and an outer end of said neck, said tremolo mechanism comprising;

a. a pivot mechanism for pivotably supporting a pivot block, said pivot mechanism comprising,
   i. a pivot plate having protruding upwardly from an upper surface thereof a laterally disposed pivot shaft support bar having protruding from laterally opposed ends thereof a pair of laterally disposed pivot shafts,
   ii. a pair of laterally spaced apart pivot shaft bearing support mounts having therein bearings for rotatably supporting said pivot shafts, each of said bearing support mounts having attached thereto a mounting bracket for attachment to a front surface of the body of a musical instrument, b. a pivot block which protrudes downwardly from said pivot plate, said pivot block having located near a lower end thereof at least one return spring attachment structure for engagement by a first end of a tremolo mechanism return spring, c. an extended lip portion including an upright laterally disposed plate which protrudes upwardly from said pivot plate near a rear laterally disposed edge thereof, d. a plurality of laterally spaced apart, longitudinally adjustable bridge segments located forward of said extended lip portion and disposed parallel to and above the upper surface of said pivot plate, each of said adjustable bridge segments having at a front end thereof a string guide having therein a groove for supporting a string anchored by a string anchor structure to said pivot block at a first, lower end of said string and anchored at a second, upper end of said string to a tuning peg, each of said adjustable bridge segments having associated therewith an individual longitudinal position adjustment mechanism, whereby longitudinal adjustment of said adjustable bridge segment varies the tension and hence vibrating frequency of a said string, e. a plurality of laterally spaced apart string anchor structures fixed to at least one of said pivot block and said pivot plate at a location below and rearward of said string guides of said adjustable bridge segments, f. at least a first tremolo mechanism return spring secured at a first, lower end thereof to said return spring attachment structure of said pivot block and at a second, upper end thereof to said body to thus exert a torque on said pivot block in opposition to torque exerted thereon by tension of said strings, and g. a tremolo arm protruding upwards from said pivot plate and graspable by an instrument player to pivot said pivot plate and said extended lip portion downwards against torque exerted by said tremolo mechanism return spring to thus increase tension and hence vibrating frequency of said strings, and releasable to enable said tremolo mechanism return spring to restore said pivot block, pivot plate and string tensions and frequencies to unpivoted initial quiescent values, said longitudinal position adjustment mechanism of said adjustable bridge segment comprising in combination;
   i. a threaded stud which protrudes rearwardly from said bridge segment,
   ii. a bore disposed through said upright plate of said extended lip portion, said stud protruding rearwardly through said bore and outwardly of said upright plate.
   iii. an adjustment knob which threadinaly engages said stud, and
   iv. spring means for resiliently biasing said bridge segment in a forward direction, h. a lateral adjustment mechanism for adjusting the lateral position of said bridge segments in lateral directions parallel to an upper surface of said pivot plate, said lateral adjustment mechanism including in combination:
   i. a transverse rail laterally slidably located within a rail support groove laterally disposed within said upright plate of said extended lip portion, said rail having through its thickness dimension a plurality of horizontal laterally spaced bores for receiving individual threaded studs of said adjustable bridge segments, and
   ii. an index mechanism for adjusting the lateral position of said rail in said rail support groove, and i. a detent mechanism for retaining said adjustment knob at an adjusted angle, said detent mechanism comprising in combination, at least one tang protruding forward from said knob, and a laterally elongated channel groove formed in a rear surface of said transverse rail for receiving said tang, said channel groove being vertically centered on said threaded stud bores.

2. The tremolo mechanism of claim 1 wherein said spring means comprises a compression spring which is coaxially located over said stud and disposed between said upright plate of said extended lip portion and said bridge segment.

3. The tremolo mechanism of claim 2 wherein said compression spring has a tapered conical shape, a smaller diameter front transverse end of which bears against said a rear surface of said bridge segment.

4. The tremolo mechanism of claim 1 further including a detent mechanism for retaining said adjustment knob at an adjusted angle, said detent mechanism having a first configuration enabling rotation of said adjustment knob and a second configuration preventing rotation of said adjustment knob.

5. The tremolo mechanism of claim 4 wherein said detent mechanism includes in combination at least a first projection which protrudes from one of said knob and said extended lip portion and a first groove which protrudes into the other of said knob and said extended lip portion.

6. The tremolo mechanism of claim 1 further including a plurality of vertically disposed cross grooves in said rail for receiving said tang, each of said cross grooves being laterally centered on a separate one of said through-bores for said studs.

7. The tremolo mechanism of claim 1 wherein said index mechanism is further defined as including at least a first set screw threadingly received in a first laterally disposed threaded bore in a first side of said upright plate of said extended lip portion, said set screw bearing against a first side of said transverse rail.

8. The tremolo mechanism of claim 7 wherein said index mechanism is further defined as including a second set screw threadingly received in a second laterally disposed threaded bore located in a second side of said upright plate of said extended lip portion on a second, opposite side of said transverse rail and bearing against said second side of said transverse rail.

9. The tremolo mechanism of claim 1 wherein said return spring attachment structure is further defined as including a bore which penetrates said pivot block.

10. The tremolo mechanism of claim 1 further including a tremolo arm angular motion resistance adjustment mechanism for adjusting resistance to motion of said tremolo arm in a plane parallel to said pivot plate.

11. The tremolo mechanism of claim 10 wherein said tremolo arm angular motion resistance adjustment mechanism includes an externally threaded vertical inner end of said arm, a bore disposed downwards through said pivot plate and into a blind threaded bore which extends downwardly into said pivot block, for threadingly receiving said threaded end of said arm, and a compression spring located between a lower end of said threaded end and a bottom wall of said blind bore whereby torsional resistance to angular motion of said arm is increasable by rotating said threaded end of said arm to thereby increase compression of said spring to thus maintain said arm at an adjusted angle.

12. The tremolo mechanism of claim 1 wherein said string anchor structure is further defined as including a string anchor channel disposed through said pivot plate into said pivot block.

13. The tremolo mechanism of claim 12 wherein said adjustable bridge segment is further defined as having disposed through its thickness dimension rearward of said string guide portion thereof a slotted aperture for receiving therethrough a string disposed through said string anchor channel.

14. The tremolo mechanism of claim 1 wherein said return spring attachment structure is further defined as at least one of a projection protruding from and a bore protruding into said pivot block.

15. The tremolo mechanism of claim 1 further including a vertical adjustment mechanism for adjusting the vertical position of an individual bridge segments in a direction perpendicular to an upper surface of said pivot plate.

16. The tremolo mechanism of claim 15 wherein said vertical adjustment mechanism includes at least one rotatable screw disposed downwardly through a said bridge segment and having a lower shank end which bears against an upper surface of said pivot plate.

17. The tremolo mechanism of claim 1 further including a vertical adjustment mechanism for adjusting the vertical position of an individual bridge segment in a direction perpendicular to an upper surface of said pivot plates.

18. The tremolo mechanism of claim 17 wherein said vertical adjustment mechanism includes at least one rotatable screw disposed downwardly through a said bridge segment and having a lower shank end which bears against an upper surface of said pivot plate.

19. A tremolo mechanism for varying tension and hence vibration frequencies of a plurality of strings of a stringed musical instrument having a body, a neck protruding from said body, a tuning head terminating said neck, a bridge attached to said body for securing first ends of a plurality of strings, a plurality of longitudinally disposed strings extending from said bridge above an upper surface of said neck and across and in contact with a nut comprising a laterally disposed rib which protrudes upwardly from said neck near an upper end thereof, said strings being secured at second ends thereof to individual tuning mechanisms located between said nut and an outer end of said neck, said tremolo mechanism comprising;

a. a pivot mechanism for pivotably supporting a pivot block, said pivot mechanism comprising,
   i. a pivot plate having protruding upwardly from an upper surface thereof a laterally disposed pivot shaft support bar having protruding from laterally opposed ends thereof a pair of laterally disposed pivot shafts,
   ii. a pair of laterally spaced apart pivot shaft bearing support mounts having therein bearings for rotatably supporting said pivot shafts, each of said bearing support mounts having attached thereto a mounting bracket for attachment to a front surface of the body of a musical instrument, b. a pivot block which protrudes downwardly from said pivot plate, said pivot block having located near a lower end thereof at least one return spring attachment structure for engagement by a first end of a tremolo mechanism return spring, c. an extended lip portion including an upright laterally disposed plate which protrudes upwardly from said pivot plate near a rear laterally disposed edge thereof, d. a plurality of laterally spaced apart, longitudinally adjustable bridge segments located forward of said extended lip portion and disposed parallel to and above the upper surface of said pivot plate, each of said adjustable bridge segments having at a front end thereof a string guide having therein a groove for supporting a string anchored by a string anchor structure to said pivot block at a first, lower end of said string and anchored at a second, upper end of said string to a tuning device, each of said adjustable bridge segments having associated therewith an individual longitudinal position adjustment mechanism, whereby longitudinal adjustment of said adjustable bridge segment varies the tension and hence vibrating frequency of a said string, e. a plurality of laterally spaced apart string anchor structures fixed to at least one of said pivot block and said pivot plate at a location below and rearward of said string guides of said adjustable bridge segments, each of said string anchor structures including a string-holder bore which extends downwardly from an upper surface of said pivot plate through said pivot plate and into said pivot block, said bore having an entrance opening in said upper surface which includes a-rear, generally circular cross-section entry channel of larger diameter than an anchor body attachable to an end of a string, a longitudinally elongated, vertically disposed, generally rectangularly-shaped transition channel which protrudes forward from said rear entry channel, said transition channel having a width greater than the diameter of said string, and a vertically disposed, generally circular cross-section front string anchor channel which is penetrated at a rear side thereof by said transition channel, said anchor channel having a diameter smaller than that of said string anchor body to thus form an anchor pocket for restraining upward motion of a string which has been inserted into said rear entrance channel and slid forward in said transition channel into said anchor channel.

f. at least a first tremolo mechanism return spring secured at a first, lower end thereof to said return spring attachment structure of said pivot block and at a second, upper end thereof to said body to thus exert a torque on said pivot block in opposition to torque exerted thereon by tension of said strings, and g. a tremolo arm protruding upwards from said pivot plate and graspable by an instrument player to pivot said pivot plate and said extended lip portion forward against torque exerted by said tremolo mechanism return spring to thus decrease tension and hence lower the vibrating frequency of said strings, and releasable to enable said tremolo mechanism return spring to restore said pivot block, pivot plate and string tensions and frequencies to unpivoted initial quiescent values.

20. The tremolo mechanism of claim 19 wherein said string anchor bore penetrates a lower surface of said pivot block to provide thereat a lower access opening for accessing a string.

* * * * *